US005429530A

United States Patent [19]

Zander et al.

[11] Patent Number: 5,429,530

[45] Date of Patent: Jul. 4, 1995

[54] CABLE CONNECTOR INCLUDING THERMAL FUSE

[75] Inventors: Jeffrey E. Zander, Minnetonka; Jay J. Kakuk, Plymouth, both of Minn.

[73] Assignee: The Toro Company, Bloomington, Minn.

[21] Appl. No.: 246,433

[22] Filed: May 20, 1994

[51] Int. Cl.[6] ..... H01R 13/68

[52] U.S. Cl. ..... 439/622; 439/411

[58] Field of Search ..... 439/621, 622, 411, 412, 439/417; 337/186, 187

[56] References Cited

U.S. PATENT DOCUMENTS

| | | | |
|---|---|---|---|
| 771,144 | 9/1904 | Gould | 337/412 |
| 1,156,717 | 10/1915 | Smith | 337/402 |
| 1,539,293 | 5/1925 | Bridges | 337/1 |
| 2,204,237 | 6/1940 | Slack et al. | 200/142 |
| 2,704,797 | 3/1955 | Fettweis | 200/142 |
| 2,920,163 | 1/1960 | Johnson | 200/113 |
| 4,203,053 | 5/1980 | Shepard | 315/254 |
| 4,337,374 | 6/1982 | Smith | 174/138 |
| 4,513,238 | 4/1985 | Orban | 320/23 |
| 4,581,674 | 4/1986 | Brzozowski | 361/104 |
| 4,776,809 | 10/1988 | Hall | 439/116 |
| 4,997,394 | 3/1991 | Katz et al. | 439/622 |
| 5,007,855 | 4/1991 | O'Brien et al. | 439/211 |
| 5,055,071 | 10/1991 | Carlson et al. | 439/621 |
| 5,177,658 | 1/1993 | Brenner et al. | 361/103 |

FOREIGN PATENT DOCUMENTS

| | | | |
|---|---|---|---|
| 2661283 | 10/1991 | France | 439/411 |

*Primary Examiner*—Gary F. Paumen

*Attorney, Agent, or Firm*—David George Johnson; Donald S. Trevarthen

[57] ABSTRACT

A cable connector (82) including a thermal fuse (25) for use with a low voltage electrical system (1). The preferred connector (82) includes a pair of electrically and thermally conductive jumper elements (19,23) with a plurality of sharpened edges (30,33,64,67) for piercing the insulating jacket (32,35,73,74) surrounding the inner conductors (14,15,22,24) with which the jumpers (19,23) make electrical contact. The jumpers (19,23) include a plurality of conductor engaging slots (31,34,65,66,68,69) which mechanically grip the conductors. In operation, the quality of the electrical contact between the jumpers and the conductors is proportional to the amount of heat radiated at the junction between the terminals (26,27,62,63) and the conductors (14,15,22,24), the heat causing the thermal fuse (25) to break the electrical circuit when the sensed heat exceeds a predetermined threshold.

20 Claims, 4 Drawing Sheets

CABLE CONNECTOR INCLUDING THERMAL FUSE

BACKGROUND OF THE INVENTION

1. Field of The Invention

The invention relates generally to temperature detectors used in conjunction with electrical connectors, and more particularly to insulation displacement type electrical connectors utilized in outdoor lighting systems.

2. Description of Related Technology

Low voltage outdoor lighting systems typically include several components. Among these components are an electrical transformer for converting standard household (120 volts) alternating current into a lower voltage (approximately 12 volts) alternating current. Such systems also utilize various lighting fixtures which are typically mounted above the ground. These fixtures include sockets for low voltage electrical lamps and lenses for refracting light emitted by the lamp. The light fixtures are typically mounted or placed in the ground some distance from the power transformer which is typically located or mounted on the side of the home. The lighting fixtures are connected to, and supplied with electric current from the transformer by a series of main and possibly smaller feeder electrical cables that run underground from the transformer location to the various light fixture locations. In some cases, the light fixtures are connected, physically and electrically, directly to the main cable without any feeder cable running between the lighting fixture and the main cable. In those cases, the light fixture has means incorporated in it for directly connecting to the main cable.

Typically, one main cable runs from the transformer to the ground area where the lighting fixtures are placed. This main cable is relatively large as it must carry the total current for the sum of the lighting fixtures. The cable must be extended or a branch line added on occasion as required by the particular installation, which requires that an additional length of the main cable be connected to the original length of main cable by a connecting device or terminal, which physically and electrically joins the two cables to each other. This interconnection of the main cables is accomplished by a cable connector. Since the installation is to be accomplished in the field by a person not skilled in electrical work, the connector is preferably of the insulation displacement type, thereby eliminating the use of solder, special tools, or a knowledge of standard cable splicing techniques.

An example of such previously employed connectors is disclosed in U.S. Pat. No. 5,007,855, which includes a plurality of electrically conductive jumper elements, wherein each of the jumper elements is formed to include a pair of sharp protrusions. The cable connector also includes a cap wherein the cap consists of an electrically insulating material which engages the electrically conductive jumper elements. The cable connector, commonly known as an insulation displacement type cable connector, also includes a base formed of an electrically insulating material so as to have a plurality of channel like cavities for accepting the electrical cables. The base nests within the cap and the cavities within the base are positioned so as to receive the protrusions of the conductive jumper elements engaged by the cap. A self tapping screw fastens the cap and base together as the protrusions penetrate the insulating jacket surrounding the cable and thereby make electrical contact with the cores of the cables that are being interconnected. Current can then be conducted between the two cables.

In addition, the state of the art for such connectors is exemplified by U.S. Pat. No. 5,055,071 (Carlson) discloses an in line fuse holder, and by U.S. Pat. No. 4,337,374 (Smith), which discloses a service wire splice enclosure. The main feature of the device is that it provides a moisture proof enclosure for cable splices.

In the insulation displacement type of connector such as those discussed above, the quality of the electrical connection can vary over time based on the quality of installation as well as environmental factors such as heating and cooling cycles, moisture, debris and corrosion. One indication that the electrical connection is poor in a given connector is the generation of increasing amounts of heat at the high resistance portions of the deteriorating junction. Corrosion and heat can lead to arcing, current flow through a diminished cross sectional area and thermal damage to the connector itself.

Therefore, sensing of the heat generated at a poor electrical connection and removing electrical current from the circuit after the temperature of the electrical wiring exceeds a predetermined threshold is desirable. U.S. Pat. No. 5,177,568 (Brenner et. al.) discloses a heat flow detector which is used in conjunction with a junction box which supplies electricity to an electric lamp. The Brenner disclosure is directed toward the problem of excess heat generated by a combination of improperly sized lights and excess amounts of insulation. Brenner utilizes an internal bimetallic switch that opens the circuit when the temperature exceeds a certain point, but when the connector has cooled, the bimetallic switch automatically closes. When a lamp is connected to such a connector, overheating will cause the lamp to cycle on and off indefinitely. In order for the bimetallic switch to operate effectively, an electrical resistor is positioned adjacent to the connector for the purpose of elevating the temperature of the connector to a predetermined threshold temperature. The threshold temperature is chosen so that spurious normal temperature variations are ignored by the bimetallic switch.

Another circuit interrupter that is heat sensitive is disclosed in U.S. Pat. No. 4,581,674 (Brzozowski). The Brzozowski disclosure is directed towards the terminal connection at which house wiring is attached to wall sockets. If the connection at the terminals is inadequate due to excessive resistance between the house wiring and the connectors, a subsequent electrical load (a lamp for example) will cause the junction to generate heat. Unfortunately, the circuit is not completely broken in response to an overheated condition, but rather the current is rerouted through a neon lamp which serves as an indicating device. Thus, current is still being supplied to the load and heat is still being generated at the degraded terminal connection. Further, since neon lamps tend to fail explosively, another hazard is created when additional current is rerouted through the lamp after the heat sensitive fuse opens.

U.S. Pat. No. 4,776,809 (Hall) discloses a low voltage distribution system for lamps which utilizes bimetallic strip to protect the circuit in response to excessive current flow.

U.S. Pat. No. 4,513,238 (Orban) discloses an automatic battery charger with a thermal control. In the Orban device, the heat to which a thermal switch responds is provided entirely by resistors rather than a combination of resistors and latent heat build up. The thermal switch is used to switch the battery charging circuit from a fast to a slow charging rate. Once the switch causes the slow charging circuit to actuate, it stays in the slow charge mode until the charger is turned off.

U.S. Pat. No. 4,203,053 (Shepard) discloses a low voltage distribution system for a miniature structure such as a doll house. Shepard discloses an adhesively backed, electrically supplied foil strip and a plurality of bipronged electrical fastening members which are removably attached thereto. The fastening members are preferably miniature light bulbs. A transformer is used to provide reduced voltage to the foil strip. If the transformer becomes overloaded due to high current flow, a thermal cutout may be used to open the circuit.

U.S. Pat. No. 2,920,163 (Johnson) discloses an electrical connector for building panels. The connector utilizes a fuse element which is actuated when current above a predetermined value passes through it, as would be the case when a short circuit or overload occurs.

U.S. Pat. No. 2,704,797 (Fettwies) discloses a thermally activated switch for use in a fire alarm. The device utilizes a bakelite housing in which the switch is contained, and a cap which holds a fuse pin. The fuse pin is made of a material which has a low melting point. A portion of the fuse pin is positioned so that it biases an elastic contact strip away from a tongue. When the fuse melts in response to high temperature, the elastic contact strip contacts the tongue and completes a circuit. The cap is fabricated of a heat conducting material and serves as a heat sink to permit sensing of external temperatures.

U.S. Pat. No. 2,204,237 (Slack et. al.) discloses a cable alarm and switch. The switch can be inserted between flexible connectors in a conventional electrical wire. The switch is provided with a spring biased contact which is retained in an open position by a fusible band of low melting point material. When the external temperature reaches a predetermined level, the fusible material melts and the contact completes the circuit.

U.S. Pat. No. 1,539,293 (Bridges) discloses a combined thermostatic circuit closer and sprinkler. The sprinkler is activated in response to high ambient temperature. The fusible material is used to bias a spring loaded valve in a closed position. When exposed to high temperatures, the fuse material melts and the valve is allowed to spring open. The resulting stream of water pushes against a rotatable spring loaded wheel and causes a flange to contact studs which are in electrical communication with the wires of an electrical circuit. When the flange contacts both of the studs, the circuit is completed and an alarm is sounded.

U.S. Pat. No. 1,156,717 (Smith) discloses an automatic fire alarm. Smith discloses an electrical circuit which is completed when a weight falls into a tube, thereby causing the physical interconnection of two contacts. The weight is normally held in an inactive position by a meltable material. In response to high ambient temperature, the weight is allowed to fall and thus complete the circuit.

U.S. Pat. No. 771,144 (Gould) discloses a thermostat which includes a coaxial cable to which is added a fusible material placed between the conducting elements. When the ambient temperature reaches a predetermined level, the fusible material melts, thereby bridging the coaxial elements and completing a circuit.

SUMMARY OF THE INVENTION

Accordingly, the present invention includes an improved cable connector for mechanically and electrically interconnecting low voltage electrical cables. The present invention also includes a heat sensitive element which constantly monitors the quality of the connections and completely interrupts current flow through the connector when the temperature in the cable connector exceeds a predetermined level.

Specifically, the present invention includes a low voltage cable connector for mechanically and electrically connecting low voltage electrical cables where the cables include electrically conductive cores and electrically insulating materials surrounding the cores. The cable connector includes a plurality of electrically conductive jumper elements, wherein each of the elements includes a pair of conductor retaining slots surrounded by sharp, insulation piercing blades. The cable connector also includes a cap, the cap having embedded within it a heat sensitive fuse. The fuse, or thermal cut off element, is in close physical proximity to the jumper elements and is itself a jumper element between a single conductor in each of the two adjacent cables housed within the connector.

The cable connector of the present invention also includes a discrete, separable cable guiding and retaining element within which two individual multiconductor cables are confined. The retaining element also serves as a jig or alignment fixture for the insulation piercing blades of the jumper elements, thereby insuring that the blades accurately pierce the jacket surrounding the cable and engage the desired individual conductors within.

The present invention also includes a discrete base member within which are embedded two adjacent jumper elements. The jumper elements interconnect the same-two conductors together at slightly displaced locations along the length of the cable, thereby providing redundancy at points between the opposite endpoints jumper element which contains the thermal cut off. This design insures that more heating occurs within the conductor that has the thermal cut off in line, there being more mass as well as more points of contact engaging the conductors opposite the thermal cut off.

The three elements which make up the present connector, namely the cap, cable retaining element and base are all securely held together in an abutting relationship by means of a single bolt which passes through each of the elements and is threadably engaged by a nut which nests into the side of the base member.

BRIEF DESCRIPTION OF THE DRAWINGS

In the detailed description of the preferred embodiments of the invention presented below, reference is made to the accompanying drawings, in which:

FIG. 3 is an exploded view of a preferred cable connector constructed according to the principles of the present invention;

DETAILED DESCRIPTION OF THE PREFERRED EMBODIMENT

Figure 1:
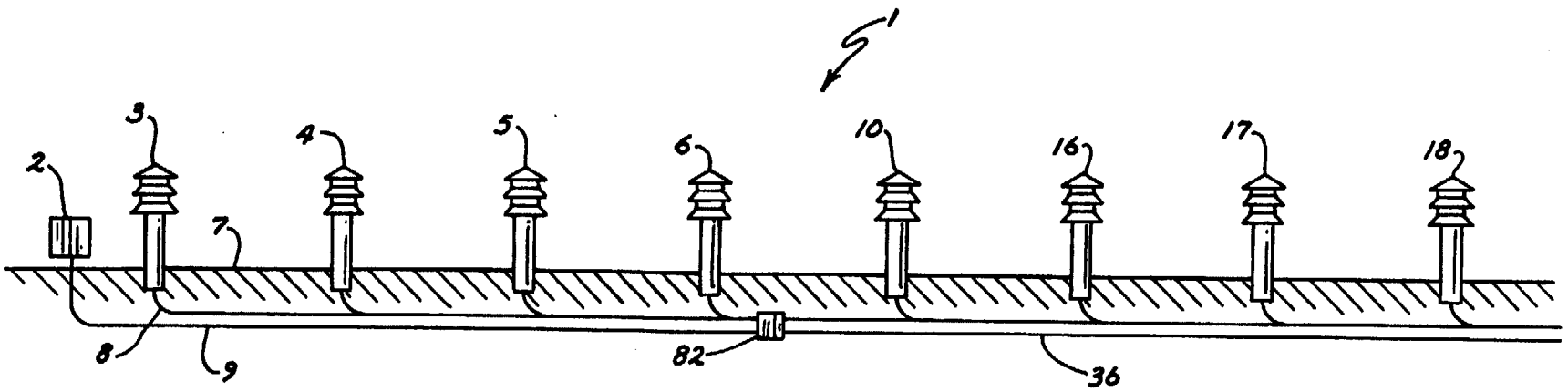
FIG. 1 is a side elevational view of a typical low voltage outdoor lighting system.

In the Drawings, wherein like reference numerals designate like parts and assemblies throughout the several views, FIG. 1 shows a side elevational view of a typical low voltage outdoor lighting system 1. The system 1 includes an electrical power transformer 2 for transforming standard household alternating current (typically 120 volts) to low voltage (typically 12 volts) alternating current. The transformer 2 is typically mounted on the outside wall of a home (not shown). The system 1 also includes a plurality of lighting fixtures 3, 4, 5 and 6, for example, which are implanted into the ground 7 as a means of securing the fixture into the outdoor environment. Each fixture, such as fixture 3, for example, is electrically connected to the power transformer 2 by means of a light fixture feeder cable 8, or is directly connected to a main cable 9 running from the transformer 1.

Figure 2:
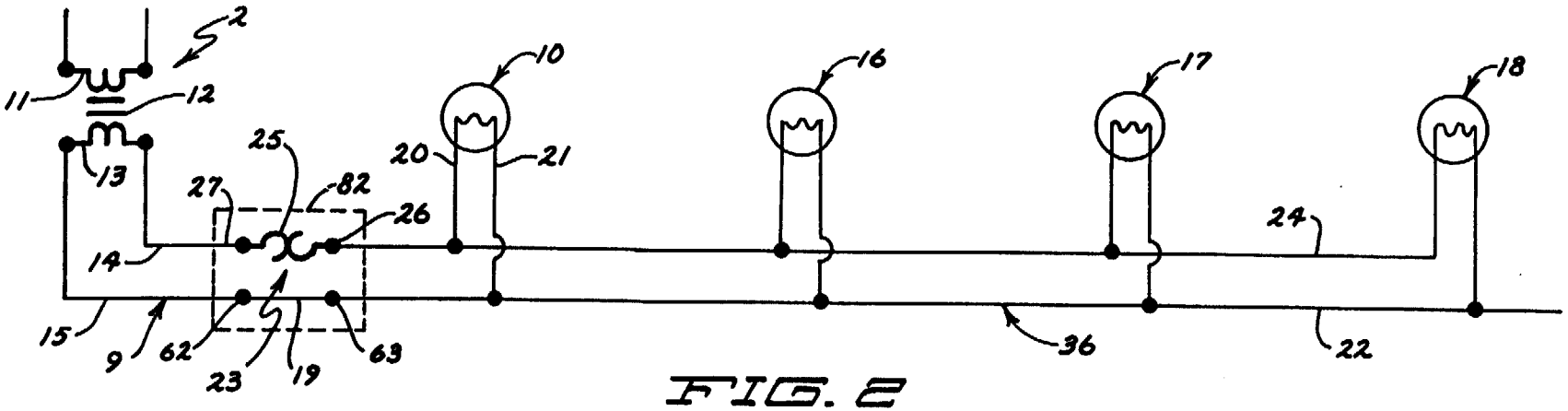
FIG. 2 is a schematic diagram of a low voltage lighting system depicted in FIG. 1, with some of the lamps deleted for clarity.
Figure 9:
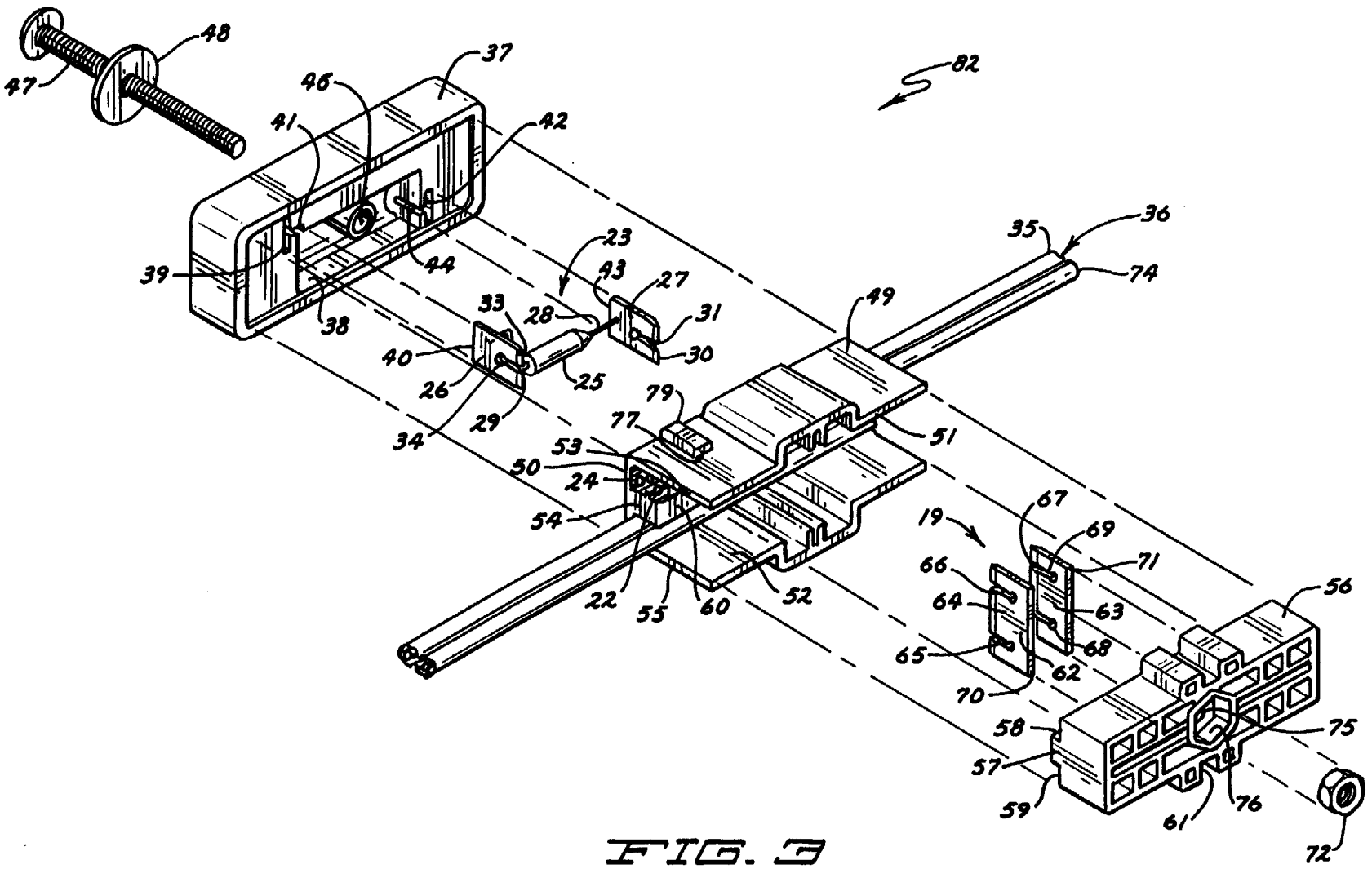
Figure 4:
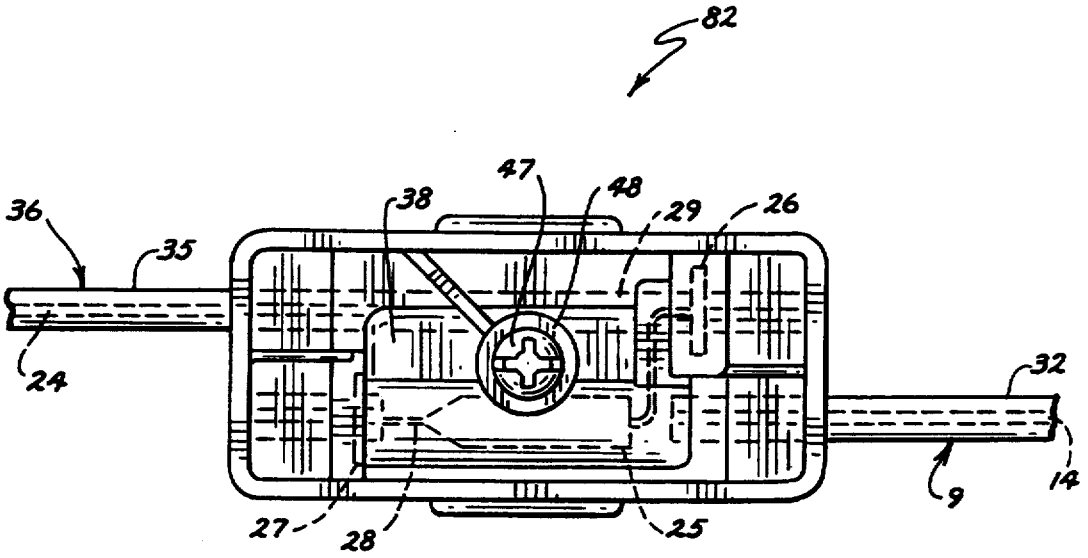
FIG. 4 is a top plan view of the cable connector depicted in FIG. 3 wherein the connector is assembled so as to interconnect cables having substantially identical gauges.

FIG. 2 shows an electrical schematic diagram of the low voltage lighting system 1, which is identical to the system 1 as depicted in FIG. 1 except for the deletion of lamps 3, 4, 5 and 6. The primary winding 11 of transformer 2 is connected to a high voltage alternating current supply, and the inductive action of transformer core 12 and secondary winding 13 causes a reduction in the voltage across conductors 14 and 15 to a value of approximately twelve volts. Conductors 14 and 15 reside together, separated by an insulating layer, within main cable 9. The fixture feeder cable 8 consists of two conductors 20 and 21 which reside together but which are also separated by an insulating layer.

As seen best in FIG. 1, the distance between the transformer 2 and the last series of light fixtures 10, 16, 17 and 18 is greater than the length of main cable 9. Thus, a cable connecter 82 is needed to interconnect or splice main cable 9 to a new length of cable 36. Each of the light fixtures 10, 16, 17 and 18 intercepts and electrically interconnects to the two conductors 22 and 24 of cable 36. Referring to FIGS. 2 and 3, the connector 82 is seen to include a jumper element 19 which joins main conductor 15 to extension cable conductor 22, while jumper element 23 joins main conductor 14 to extension cable conductor 24. Jumper 23 is seen to include a normally closed switch 25 which resides between jumper terminals 26 and 27. This normally closed switch 25 is actually a thermal cut off, or heat sensitive fuse, which opens the circuit path between conductors 14 and 24 when the temperature of the fuse 25 reaches a predetermined threshold level. The thermal cut off 25 is a nonresettable device which therefore requires replacement of connector 82 when failure occurs.

Note that a current sensitive fuse is not suitable as a substitute for normally closed switch 25, since corrosion of the electrical contacts causes current flow to decrease, rather than increase. Corrosion at the jumper assemblies or elements 19 and 23 results in reduced cross sectional area of the contacts 26 and 27 interconnecting the conductors 14 and 24, and hence greater electrical resistance. The heat generated at such a deteriorated terminal is greater than the heat generated at an uncorroded terminal, and is conducted as heat through the leads 28 and 29 to the thermal cut off element 25.

Failure of connector 82 affects the function of the remaining light fixtures 10, 16 and 18, which immediately cease to be illuminated. The fact that connector 82 requires replacement can therefore be easily diagnosed, since light fixtures 3, 4, 5 and 6 will continue to be illuminated.

Referring now to FIG. 3, the actual construction of the cable connector 82 will be discussed. The jumper element or assembly 23 includes the thermal cut off 25 which is formed as a small cylinder approximately 40 mm in diameter and 150 mm in length. Wire leads 28 and 29 exit from opposite ends of the cylinder 25. In a preferred embodiment, the thermal cutoff 25 is Part No. G4A00098C, manufactured by Therm-O-Disc, Incorporated, a subsidiary of Emerson Electric, 1320 South Main Street, Mansfield, Ohio 44907-0538. This particular device has an open circuit temperature threshold of approximately ninety eight degrees Celsius. Lead 28 of thermal cut off 25 is electrically and thermally connected, such as by soldering, welding or crimping to a brass terminal 27. The brass terminal 27 is formed as a substantially rectangular plate having a sharpened edge 30 within which resides a narrow slot 31. The width of the slot 31 is such that it will be slightly smaller than the outside diameter of conductor 14. In use, the edge 30 of terminal 27 is forced against the insulating jacket 32 which surrounds conductor 14, thereby cutting through the insulation 32 and forcing center conductor 14 into slot 31, causing conductor 14 to be held in rigid mechanical contact with terminal 27 as well as forming an electrical contact with lead 28 of thermal cut off 25.

The opposite lead 29 of thermal cut off 25 is electrically and thermally connected to brass terminal 26, which is substantially identical to terminal 27 just described. Terminal 26 includes a sharpened edge 33 and a conductor retaining slot 34. In use, the edge 33 of terminal 26 is forced over the insulating jacket 35 which surrounds center conductor 24 of fixture feeder cable 36, securing the center conductor 24 within slot 34.

The jumper element or assembly 23 is housed within a cap member 37 which forms one of the three discrete components of connector 82. The cap 37 is integrally molded from a high temperature thermoplastic material and is substantially rectangular in shape. A recess 38 is formed within cap 37, the recess being adapted to receive thermal cut off 25. During initial assembly of the connector 82 at its point of manufacture, thermal cutoff 25 is inserted into recess 38 and permanently affixed there by a suitable potting compound (not shown). The recess 38 includes a cavity 39 for receiving end 40 of terminal 26, and an adjacent channel 41 within which lead 26 resides. The recess 38 also includes cavity 42 which is adapted to receive end 43 of terminal 27, and an adjacent channel 44 within which lead 28 resides.

At or near the center of cover 37 an orifice 46 (best seen in FIG. 6) is formed, permitting a bolt 47 to pass completely through cap 37 and adjacent to thermal cut off 25. A washer 48 is placed against cap 37 to serve as a bearing surface.

Referring also to FIGS. 4, 5, 6 and 7, the manner in which the cables 36 and 9 are retained and aligned with respect to jumper 23 can be appreciated. The second discrete component of the connector 82 is the guide element 49, which is formed as an integrally molded part composed substantially of a high temperature thermoplastic. The guide 49 is shaped so as to include a top wall 50, a first side wall 51 and a second side wall 52. The ends and bottom of the guide 49 are left open in order to permit insertion of the cables and the remaining jumper assembly or element 19 into the guide 49.

Extending along the central region of the inner surface of top wall 50 is a ridge 54 which extends downwardly from the top wall 50 for a distance somewhat less than half of the height of the sidewalls 51 and 52. The presence of the ridge 54 creates a first channel 53 adjacent to the base of first wall 51, and creates a second channel 55 adjacent to the base of the second wall 52. Within either channel 53 or 55 is placed the main power cable 9, the cable 9 being formed as two adjacent conductors 14 and 15 which are surrounded and separated by insulating jacket 32.

The second channel 55 is suitably dimensioned so as to snugly retain the cable 9, the cable 9 being oriented so that the conductor 14 is relatively near the top wall 50, while the conductor 15 is relatively farther away from the top wall 50. The first channel 53 is suitably dimensioned so as to snugly retain the extension cable 36, the cable 36 being substantially identical in construction and dimensions to main cable 9. Since the power handling requirements of feeder cable 36 are frequently substantially identical to those of main cable 9, the use of the same cable type in both channels is often appropriate from an electrical viewpoint and greatly simplifies installation of the cables 9 and 36 within the connector 82. Depending on the electrical loads placed upon the feeder cable(s), it may also be possible to transition from, for example, an initial length of 12 gauge wire to 14 gauge wire and then even to a length of 16 gauge wire.

The final discrete component of the connector 82 is the base member 56. Base member 56 is formed as an integrally molded plastic insert suitably dimensioned to nest snugly between the first wall 51 and the second wall 52 of the guide member 49. The base member 56 includes a central ridge 57 adjacent to first shoulder 58 and second shoulder 59. When ridge 57 is placed against the top surface 60 of guide element ridge 54, a pair of adjacent conduits are formed within which cables 9 and 36 are securely retained. The center section 61 of base member 56 is enlarged somewhat so as to accommodate permanently the mounting of jumper element 19. The jumper element or assembly 19 is formed as a first contact 62 and a second contact 63, both of which are substantially identical to each other and preferably formed of brass or some other suitably conductive material. The combination of contacts 62 and 63 is relatively more massive than the contacts 26 and 27 associated with jumper element 23 and in fact doubles the available contact surface as well as halving the current flow through each contact 62 and 63. This results in relatively less heat generation from jumper element or assembly 19, thereby tending to make jumper 23 the "hotter" of the two jumper assemblies. This is a desirable condition, insofar as the thermal cut off 25 is associated with jumper assembly 23, and it will therefore sense an elevated temperature condition first and open the circuit joining conductors 14 and 24.

The first contact 62 is formed to include a sharpened edge 64 within which are formed a first conductor retaining slot 65 and a second conductor retaining slot 66. The second contact 63 includes a sharpened edge 67 and two conductor retaining slots 68 and 69. The base edges 70 and 71 of contacts 62 and 63, respectively, are embedded by pressure or a suitable adhesive within the center portion 61 of base member 56 such that contacts 62 and 63 are substantially parallel to each other, while being substantially perpendicular to the top surface of ridge 57.

In operation, the connector 82 is made available to the end user as the three discrete components of cap 37, guide 49 and base 56, along with the attaching hardware of bolt 47, washer 48 and nut 72. The main cable 9 is placed within the channel 55 and the extension cable 36 is placed within channel 53 of the guide element. One should note that placing the cables 9 and 36 within the opposite channels is also permissible as it will result in forming exactly the same functional electrical circuit as is depicted in FIG. 2. The extension cable 36 and the main cable 9 should each be placed within the guide element 49 such that they extend substantially the entire length of the guide 49, and may protrude beyond the end of the guide 49 without harmful effect. Once the cables 9 and 36 are positioned within their respective channels, the base element 56 is inserted between outer walls 51 and 52 of the guide element 49. By pressing the base 56 into the guide 49, the edges 64 and 67 of jumper assembly or element 19 cut through the insulating jacket 73 surrounding main cable conductor 15 as well as through insulating jacket 74 which surrounds extension cable conductor 22. The slot 65 grips conductor 15 while the adjacent slot 66 of terminal 62 engages and grips conductor 22, thereby making both mechanical and electrical contact between conductors 15 and 22. Similarly, conductors 15 and 22 are again joined by the action of slot 68 and slot 69, respectively, of terminal 63.

The next step in assembling connector 82 is to place the cap 37 onto the upper surface of the guide 49. A pair of slot like orifices (not shown) are formed within the top of guide 49 which permit terminals 26 and 27 to pass through the top of the guide 49 and engage the cables 9 and 36. The sharp edge 30 of terminal 27 cuts through the insulation 32 surrounding main cable conductor 14. The mechanical engagement with the slots 34 and 31 of contacts 26 and 27, respectively, creates a circuit path from the main conductor 14 through the thermal cut off fuse 25 and to terminal 26. The sharpened edge 33 of the terminal 26 cuts through the insulation 35 surrounding extension cable conductor 24, thereby completing the electrical circuit between the main cable 9 and the extension cable 36.

Figure 5:
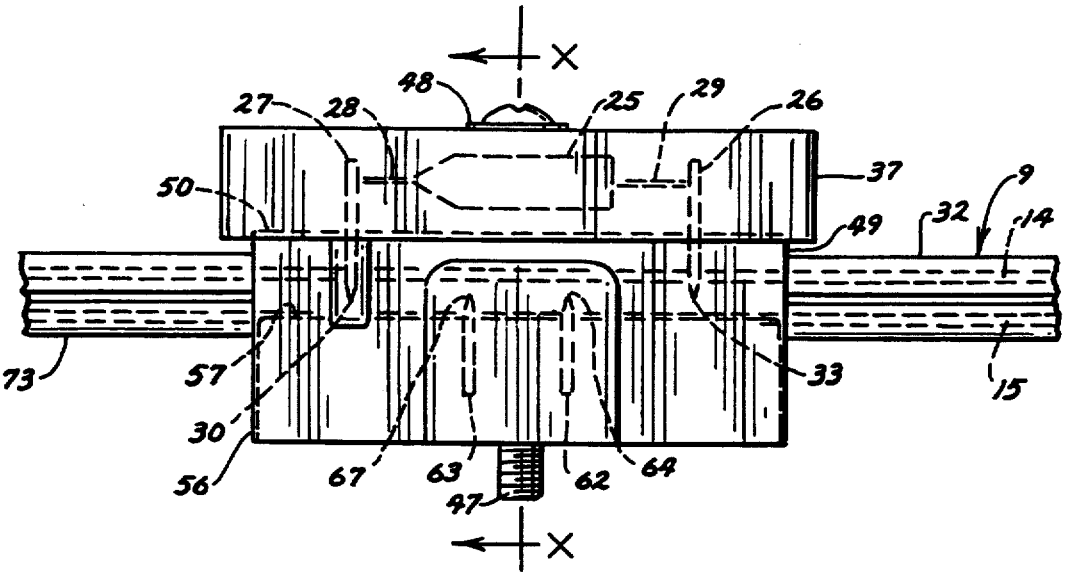
FIG. 5 is a side elevational view of the connector depicted in FIG. 4.
Figure 6:
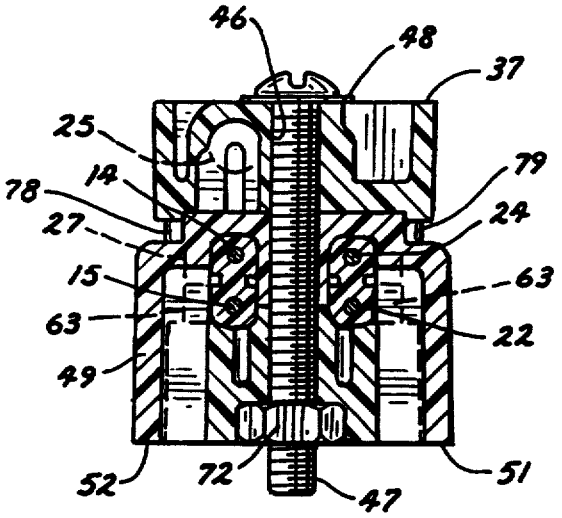
FIG. 6 is a sectional view of the connector of the present invention taken along lines X—X of FIG. 5.
Figure 7:
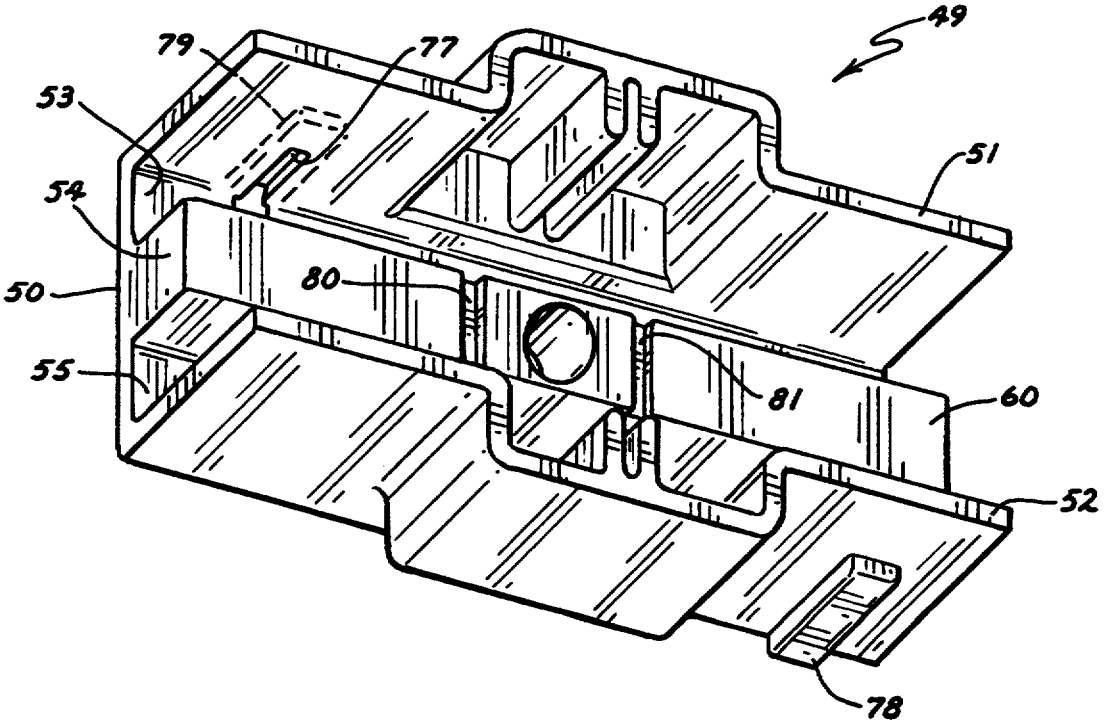
FIG. 7 is a perspective view of the guide element of the connector illustrated in FIG. 6.

The bolt 47 is inserted through the washer 48 and sequentially through the cap 37, guide 49 and exits through orifice 75 which is formed in the bottom wall of base 56. A nut 72 is retained within a cavity 76 formed adjacent to orifice 75, thereby permitting the connector 82 to be compressed as the bolt 47 is tightened. Referring also to FIGS. 5, 6 and 7, one can appreciate that the edge 30 of jumper assembly 23 extends past main cable conductor 14 (with which it makes electrical contact) and continues toward adjacent main cable conductor 15. However, edge 30 is prevented from contacting conductor 15 due to the presence of molded in stop 78 which is formed as a groove within the wall 52 of guide member 49. Also, the edge 33 of terminal 26 makes electrical contact with center conductor 24 of extension cable 36, and extends beyond conductor 24 toward adjacent extension cable conductor 22. Edge 33 is prevented from contacting conductor 22, however, by the presence of stop 77 which is formed within the shoulder 79 Similarly, the edges 67 and 64 of jumper assembly 19 extend past main cable conductor 15 and extension cable conductor 22 (with which they both make electrical contact) and continue toward adjacent main cable conductor 14 and extension cable conductor 24. Contact between jumper assembly or element 19 and conductors 14 and 24 is prevented by the presence of stops 80 and 81, however, which are formed as grooves within central ridge 60 of guide 49. Additionally, the surface 60 of central ridge 54 of guide 49 abuts against ridge 57 of base member 56 to serve as a stop to prevent excessive travel of edges 64 and 67 into the cables 9 and 36.

Once the connector 82 has been completely assembled with its cables 9 and 36 in place, the circuit 1 will quite possibly be energized on a daily basis for hours at a time. Over a period of years either one of the contacts 26 or 27 may deteriorate due to corrosion or other factors which would tend to reduce the available cross sectional area for current flow. Since the contacts 26 and 27 are relatively less massive, and hence carry a greater current flow, than contacts 62 and 63, the contacts 26 and 27 would almost certainly deteriorate to an unacceptable cross sectional area well before a similar condition was reached by the contacts 62 and 63. As discussed earlier, the reduced cross sectional area of either contact 26 or 27 will result in the generation of heat, and the operating temperature of the contacts 26 or 27 will be elevated, eventually reaching a temperature on the order of 100° Centigrade. This temperature will cause thermal cut off element 25 to become an open circuit, thereby interrupting current flow between contacts 26 and 27 and hence through conductor 24. This open circuit condition will extinguish all "downstream" lights 10, 16, 17 and 18, for example, and give an immediate indication that the connector 82 has failed. Insofar as thermal cutoff 25 is a nonresettable device, the connector 82 will need to be entirely replaced, an operation that may be easily accomplished on site in less than five minutes, the only tools needed being a simple screwdriver and a pair of wire cutters.

The connector 82 has been described with reference to a particular configuration, but its application is general and may easily be adapted to a variety of situations by varying the size or shape of conductor retaining slots 65 and 66, altering the size or shape of contacts 62 or 63, or adjusting the characteristics of the thermal cut off 25. The conductors 14, 15, 22 and 24 may be of either stranded or solid configuration, and may be associated with insulated cables of different sizes. Also, the principles of the present invention could be extended to interconnecting not only two cables, but also, for example, a cable and another electrical fixture, such as a plug or socket.

We claim:

1. A cable connector for interconnecting a pair of cables, the connector comprising:

(a) a pair of electrically and thermally conductive jumper assemblies;

(b) a thermal cut off element forming a part of at least one of the jumper assemblies;

(c) a cable retaining guide, the guide being adapted to align the jumper assemblies with the cables; and (d) fastening means for securing the jumper assemblies to the cables so as to engage selected conductors within the cables.

2. The cable connector of claim 1, further comprising a cap formed substantially of an electrically resistive material with means for engaging at least one of the electrically conductive jumper assemblies and wherein the thermal cut off element includes a first electrical lead and a second electrical lead and wherein the first jumper assembly comprises:

(a) a first terminal wherein the first terminal is connected to the first electrical lead of the thermal cut off element; and (b) a second terminal wherein the second terminal is connected to the second electrical lead of the thermal cut off element.

3. The cable connector of claim 2, wherein the first terminal is formed as a substantially planar rectangle, comprising:

(a) a first edge, the first edge being adapted to engage the cap;

(b) a second edge, the second edge being adapted to engage a cable; and (c) at least one slot, the slot being formed so as to be substantially perpendicular to the second edge and thereby retain a cable conductor therein.

4. The cable connector of claim 3, wherein the second edge of the first terminal is sharpened, thereby tending to penetrate the insulation surrounding the conductor when the first terminal engages the cable.

5. The cable connector of claim 4, wherein the cap is formed as a substantially rectangular solid, the cap including a cavity, the cavity being adapted to receive the first jumper assembly.

6. The cable connector of claim 5, wherein the guide is formed so as to include a top wall, a first side wall and a second side wall, the first and second side walls being joined to the top wall, thereby forming an open channel.

7. The cable connector of claim 6, wherein the top wall of the guide includes an outer surface and an inner surface, the outer surface being adapted to reside in an abutting relationship with the cap.

8. The cable connector of claim 7, wherein the top wall of the guide is formed so as to include a pair of slot like orifices, the slot like orifices being aligned so as to permit the first and second terminals of the first jumper assembly to pass through the top wall of the guide and engage a cable residing within the guide.

9. The cable connector of claim 8, wherein the guide further comprises a centrally located longitudinal ridge, the longitudinal ridge being integrally formed with the inner surface of the top wall of the guide, the longitudinal ridge thereby forming two substantially parallel channels, the two channels being adapted to retain a cable in an abutting relationship with the inner surface of the top wall of the guide.

10. The cable connector of claim 9, wherein the guide further comprises:

(a) a first stop element, the first stop element being integrally formed within the first side wall of the guide, the first stop element being adapted to limit travel of the first terminal of the first jumper element; and (b) a second stop element, the second stop element being integrally formed within the second side wall of the guide, the second stop element being adapted to limit travel of the second terminal of the first jumper element.

11. A low voltage electrical system having a power source, one or more low voltage devices, a first low voltage electrical cable, the cable comprising electrically conductive material encased in electrically insulating material, the cable connecting the power source to the low voltage electrical devices and at least one low voltage cable connector connecting the first low voltage electrical cable to a second cable, wherein the cable connector comprises:

(a) first and second electrically and thermally conductive jumper assemblies;

(b) a cap comprising electrically resistive material with means for engaging the first electrically conductive jumper assembly;

(c) a guide comprising electrically resistive material with a plurality of channel like cavities for accepting the electrical cables and wherein the guide is shaped and dimensioned so as to abut the cap in an operative relationship;

(d) a base, the base comprising an electrically resistive material and being shaped and dimensioned so as to nest within the guide in an operative relationship;

(e) fastening means for retaining the cap, guide and base in an abutting relationship such that the first and second electrically conductive jumper assemblies engage selected conductors of the cables; and (f) a thermal cut off element, the thermal cut off element being adapted to interrupt current flow to the second cable when the thermal cut off device reaches a temperature in excess of a predetermined amount.

12. The system of claim 11, wherein the thermal cut off element is in a series circuit relationship with the first jumper assembly.

13. The system of claim 12, wherein the first jumper assembly is in a series circuit relationship with a single conductor of the first low voltage electrical cable and a single conductor of the second cable.

14. The system of claim 13, wherein the cap is formed so as to include a cavity, the cavity being adapted to retain the thermal cut off element in an adjacent relationship to the guide, the thermal cut off element sensing temperature of conductors within the guide.

15. The system of claim 14 wherein the thermal cut off element is electrically interconnected so as to be in series with the jumper assembly having a relatively smaller mass.

16. The system of claim 15, wherein the first and second jumper assemblies include terminals composed substantially of brass, the second jumper assembly having relatively more points of contact with the cable conductors thereby tending to generate less heat than the first jumper assembly.

17. The system of claim 16, wherein the second jumper assembly comprises at least two discrete substantially parallel plates, each plate having a first edge adapted to be permanently retained by the base, each plate having a second, sharpened edge adapted to penetrate the insulation surrounding the conductors within the cables.

18. The system of claim 17, wherein each parallel plate of the second jumper assembly comprises a plurality of conductor engaging slots, each slot having a width that is less than an outside diameter of a conductor housed within the cable.

19. A low voltage cable connector for mechanically and electrically connecting a pair of two conductor low voltage electrical cables, the cables each comprising two discrete electrical conductors individually encased in electrically insulating material, the connector comprising:

(a) first and second electrically conductive jumper assemblies, the first jumper assembly being formed so as to include a first terminal and a second terminal interconnected in a series circuit relationship by means of a thermally activated fuse;

(b) a cap, the cap being formed with an internal cavity adapted to house the thermally activated fuse add portions of the first and second terminals;

(c) a jumper alignment guide element, the guide element being formed so as to include first and second orifices through which the first and second terminals of the first jumper assembly can extend and engage the cables residing within the guide element while confining the thermally activated fuse to a region outside of the guide dement;

(d) a base element, the base element being adapted to support the second jumper assembly, the second jumper assembly comprising two discrete substantially planar terminals, the base element supporting the terminals so as to be substantially parallel to each other and substantially perpendicular to the cables residing within the guide element; and (e) at least one fastener, the fastener compressing the cap, guide and base into a layered abutting relationship such that the conductors within the cables within the guide are selectively engaged by the first and second jumper assemblies.

20. The connector of claim 19, wherein the base element includes a central longitudinal ridge defining first and second channel portions and the guide element includes a central longitudinal ridge defining first and second channel portions such that assembly of the connector causes the central ridges of the guide and base elements to abut, thereby forming substantially enclosed first and second channels within which one of each of the two cables reside.

* * * * *